US007761044B2

(12) United States Patent
Yagi et al.

(10) Patent No.: US 7,761,044 B2
(45) Date of Patent: Jul. 20, 2010

(54) FIXING DEVICE AND IMAGE FORMING APPARATUS USING THE SAME

(75) Inventors: Masahiro Yagi, Ibaraki (JP); Toshio Ogiso, Ibaraki (JP); Shigeru Obata, Ibaraki (JP); Chikara Hiraoka, Ibaraki (JP); Toru Hanashima, Ibaraki (JP); Osamu Saito, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 221 days.

(21) Appl. No.: 11/508,273

(22) Filed: Aug. 23, 2006

(65) Prior Publication Data

US 2007/0048045 A1 Mar. 1, 2007

(30) Foreign Application Priority Data

Aug. 24, 2005 (JP) ..... P2005-242512
Sep. 9, 2005 (JP) ..... P2005-261909

(51) Int. Cl.
*G03G 15/20* (2006.01)

(52) U.S. Cl. ..... 399/329

(58) Field of Classification Search ..... 399/329, 399/330, 331, 328
See application file for complete search history.

(56) References Cited

U.S. PATENT DOCUMENTS

| | | | | |
|---|---|---|---|---|
| 5,621,512 | A | 4/1997 | Uehara et al. | |
| 5,666,624 | A | 9/1997 | Kanesawa et al. | |
| 2004/0131401 | A1* | 7/2004 | Nakatogawa et al. | 399/328 |
| 2004/0184850 | A1* | 9/2004 | Yoneda et al. | 399/329 |
| 2005/0047838 | A1* | 3/2005 | Uehara et al. | 399/329 |
| 2005/0220467 | A1 | 10/2005 | Takahashi et al. | |
| 2006/0056887 | A1 | 3/2006 | Maeyama et al. | |
| 2006/0083562 | A1 | 4/2006 | Matsumoto et al. | |
| 2007/0065193 | A1 | 3/2007 | Jang et al. | |
| 2007/0065194 | A1 | 3/2007 | Kim et al. | |

FOREIGN PATENT DOCUMENTS

| | | |
|---|---|---|
| JP | 8-262903 | 10/1996 |
| JP | 2001-249558 | 9/2001 |
| JP | 3282494 | 3/2002 |
| JP | 3298354 | 4/2002 |
| JP | 2004-29607 | 1/2004 |

* cited by examiner

*Primary Examiner*—David M Gray
*Assistant Examiner*—Andrew V Do
(74) *Attorney, Agent, or Firm*—McGinn IP Law Group, PLLC

(57) ABSTRACT

A ratio of a radius of curvature of a pressure applying member with an elastic layer, which pushes an endless belt wound around an endless heating member with pressure, in a transferring direction to a radius of curvature of an outer diameter of the heating roller is set to 1.1 or more.

7 Claims, 7 Drawing Sheets

FIXING DEVICE AND IMAGE FORMING APPARATUS USING THE SAME

BACKGROUND

1. Technical Field

The present invention relates to a fixing device and an image forming apparatus using the same.

2. Related Arts

As the device for fixing the unfixed toner image onto the recording medium, the heating/fixing roller heated by a halogen heater arranged in the roller, a pressure roller pressed against the heating/fixing roller by a coil spring, or the like to form a nip portion between the rollers, and a recording medium, onto which the toner is put, is heated, pressed by passing the recording medium through the nip portion.

In case various improvements such as speed up of the printing, size reduction of the housing, improvement in reliability of the product, energy saving, cost reduction, and the like are introduced, the system for bringing the above rollers into contact with each other with pressure has the problems described as follows.

In case the speed up of the printing that is important out of them is intended, a carrying speed of the recording medium is inevitably increased. At that time, in order to ensure the fixing performance of the toner equivalent to that obtained before the carrying speed is increased, the equivalent thermal energy must be applied in the fixing step. However, the measure to apply such energy by increasing a heat value of the heater goes against the energy saving. Therefore, it is supposed that the heat value of the heater is not changed.

First, it can be considered that a contact area is increased by enlarging a diameter of the roller. That is, a contact distance in the transferring direction along which the toner on the recording medium is heated is made longer. Accordingly, a heating time can be ensured. However, an increase in diameter of the roller goes against a downsizing of the housing.

Next, the method of increasing a load value by lowering an elastic modulus of the roller surface can be considered. In order to lower the elastic modulus of the roller surface, either a thickness of a surface layer of the roller is increased or a rigidity (Young's modulus) of the member must be lowered. However, when a thickness of the surface layer of the roller is increased, a heat capacity of the overall heating roller is enhanced, so that a heating time required to raise a surface temperature of the heating roller up to a predetermined temperature is prolonged. As a result, a printing time is also prolonged. Also, there is the method of maintaining a temperature of the heating roller by supplying a heat as needed during the print standby, but such method is contrary to the energy saving.

In contrast, when the load value applied to bring the rollers into contact with each other with pressure is increased, an amount of deflection of the roller is also increased and thus a pressure difference is caused between the center portion and the end portion in the axial direction of the roller. In some cases the fixing performance of the toner becomes uneven. In addition, it is possible that an uneven pressure distribution causes a paper wrinkle, and consequently reliability of the device is degraded.

When an amount of deflection is reduced, a rigidity of the roller is increased, or the roller is formed into a crown shape. In the former case that a rigidity of the roller is increased, a heat capacity of the roller is increased and also a heating time is prolonged, which is contrary to the energy saving. In the latter case, the crown-shaped roller needs a large number of steps required to form the roller, and thus a reduction in cost is difficult. A pressure distribution precision in the axial direction becomes higher in sensitivity than a machining precision of the roller. Accordingly, the reliability may be degraded.

It is disclosed, by Japanese Patent No. 3298354, that the nip portion is formed by contacting the pressure applying member whose exit portion is elastically deformable to a rotatable heating roller, whose surface is elastically deformable, with pressure in a belt nip system for fixing the toner image, and that a toner image on a recording medium is pressurized, heated, and transferred between the nip portion to be fixed.

It is disclosed, by Japanese Patent No. 3282494, that the elastic layer is provided near the surface of the heating roller, and that the pressure applying member contacts the heating roller via the endless belt to curve along an outer peripheral surface of the heating roller and presses the heating roller with an almost uniform pressure distribution.

According to Japanese Patent No. 3282494, since the pressure applying member is provided to the endless belt such that a contact surface is formed from the inner side, a nip width can be formed longer than that obtained by the method that does not employ the endless belt, and such configuration can apply enough heat to the toner. Accordingly, such configuration can respond easily to a higher speed of the printing speed. A nip width can be formed longer than that obtained by the method, which does not employ the endless belt, not to increase a size of the overall device, and such configuration can respond to the downsizing of the overall device. In addition, a long nip width can be formed at a lower pressure than that in the method that does not employ the endless belt, and a thinning of the heating roller can be made easy. Also, a heating time required until a proper temperature for the fixing can be shortened and also the printing can be started quickly, whereby the energy saving effect can be improved. Further, since a distortion is provided to the elastic layer of the exit portion of the nip by pressing the elastic layer of the heating roller by the hard member, the self-stripping (self-releasing) performance can be increased higher than that in the method that does not employ the endless belt, and thus the reliability can be enhanced.

As the fixing device of the general image forming apparatus, as shown in JP-A=8-262903, for example, the belt nip system fixing device has already been proposed to fix the unfixed toner image transferred onto the recording medium. In this belt nip system fixing device, the nip portion is formed by pressing the pressure applying belt against the heating/fixing roller, a surface of which is elastically deformed, with pressure, and then the unfixed toner image is heated/fixed by causing the recording medium to pass through the nip portion.

SUMMARY

In the fixing device of the belt nip type, such a problem exists that a shear of image is generated easily by a speed difference caused due to a local deformation of the exit portion. Since a distortion is provided locally to the elastic layer by pressing the elastic layer of the heating roller by the hard member to form a nip shape with a small curvature, a load applied to the paper (extent of curl) is increased.

It is a subject of the present invention to provide an image fixing device capable of improving the picture quality and reducing the load applied to a paper (extent of curl) by keeping self-stripping performance while achieving higher speed, smaller size, higher reliability, energy saving, and lower cost.

According to an aspect of the invention, there is provided a fixing device for fixing a toner onto a recording medium on which an unfixed toner image is formed, comprising: an endless belt movable to wound around a heating roller; a pressure applying member having a recess portion on a surface thereof opposed to the heating roller, the pressure applying member comprising an elastic layer that presses the endless belt against the heating roller; and a nip through which the recording medium is passed. A ratio of a radius of curvature of the recess portion in a transferring direction to a radius of curvature of an outer diameter of the heating roller is set to 1.1 or more. A radius of curvature of the pressure applying member is larger than a radius of curvature of the heating roller.

According to another aspect of the invention, when viewed from a sectional section, a width of the pressure applying member with respect to the transferring direction is increased gradually from a side opposing to the heating roller toward a surface on an opposite side to a surface opposing to the heating roller.

According to another aspect of the invention, the pressure applying member has at least two protrusion portions on a surface thereof opposing to the heating roller. A top end of the protrusion portion is provided on an inner side than both end surfaces in the transferring direction respectively. The top end of the protrusion portion has a curved shape.

According to another aspect of the invention, there is provided an image forming apparatus comprising: a fixing device for fixing a toner onto a recording medium on which an unfixed toner image is formed, comprising: an endless belt movable to wound around a heating roller; a pressure applying member having a recess portion on a surface thereof opposed to the heating roller, the pressure applying member comprising an elastic layer that presses the endless belt against the heating roller; and a nip through which the recording medium is passed. A ratio of a radius of curvature of the recess portion in a transferring direction to a radius of curvature of an outer diameter of the heating roller is set to 1.1 or more. A radius of curvature of the pressure applying member is larger than a radius of curvature of the heating roller.

According to the above-aspects, since a ratio of a radius of curvature of a pressure applying member with an elastic layer in the transferring direction to a radius of curvature of an outer diameter of a heating roller is set to 1.1 or more, an image fixing device capable of improving the picture quality and reducing the load applied to a paper (extent of curl) by keeping the self-stripping performance while achieving higher speed, smaller size, higher reliability, energy saving, and lower cost can be provided.

DESCRIPTION OF THE EMBODIMENTS

Embodiments of the present invention will be explained with reference to the drawings. The present invention is not limited to the embodiments.

Embodiment 1

Figure 1:
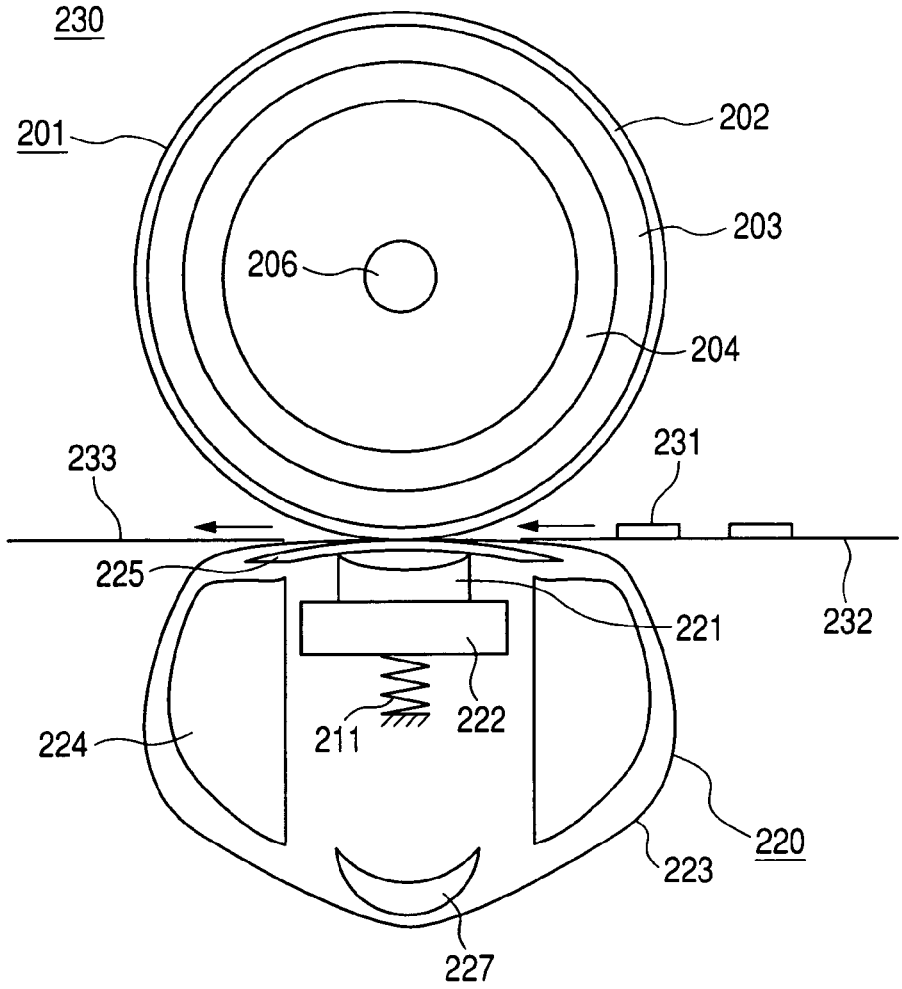
FIG. 1 is an exemplary schematic view showing a fixing device according to a first embodiment.

An image forming apparatus according to a first embodiment will be explained with reference to FIGS. 1 to 3 hereinafter. FIG. 1 is an exemplary schematic view showing a fixing device according to a first embodiment of the invention.

In FIG. 1, a fixing device 230 is composed of a heating/fixing roller 201 and a pressurizing/fixing mechanism portion 220, which are arranged such that a recording medium 232 on which an unfixed toner 231 is put can be passed through them.

The heating/fixing roller 201 for heating the unfixed toner has a heat-resistant resin layer 202 made of fluororesin, PFA, or the like on a surface coating portion. The heating/fixing roller 201 has an elastic layer 203 made of silicon rubber, fluorine-containing rubber, or the like on its inner side, and has further a core layer 204 on its inner side. Also, a heat source 206 is provided to the inside of a core layer of the heating/fixing roller 201.

The pressurizing/fixing mechanism portion 220 is provided to a position opposing to the heating/fixing roller 201. The pressurizing/fixing mechanism portion 220 includes a pressure applying member 221, a pressurizing/supporting member 222, a guide 224, a low-friction member 225, a lubricating oil supplying member 227, and a pressure applying member pressurizing unit 211 in the inside of a non-image surface side endless member 223 such as an endless belt, or the like, for example.

The pressure applying member 221 having the elastic layer and having a curvature on the non-image surface side in the transferring direction is supported by the pressurizing/supporting member 222. Then, the pressurizing/supporting member 222 undergoes a pressure from the pressure applying member pressurizing unit 211 made of a compression coil spring. The low-friction member 225 is provided between the non-image surface side endless member 223 and the non-image surface side pressure applying member 221 to reduce their friction. Also, the lubricating oil supplying member 227 for supplying a lubricating oil to the inner side surrounded by the non-image surface side endless member 223 is provided to further reduce the friction between the non-image surface side endless member 223 and the pressure applying member 221. The oil containing the silicon oil, the fluorine oil, or the like is used as this lubricating oil. Also, the guide 224 for defining a carrying route is provided on the inner side of the non-image surface side endless member 223.

As described above, a fixed image 233 is formed when the recording medium 232 that bears the unfixed toner 231 thereon is passed through a nip portion. This nip portion consists of the heating/fixing roller 201 and the pressurizing/fixing mechanism portion 220.

Next, the fixing/releasing test is conducted by using the configuration shown in FIG. 1. FIG. 2 is an explanatory view explaining experimental conditions around the pressure applying member 221 at that time. Also, an example of measured results is shown in Table 1. In this case, the test is conducted at a temperature of 20° C. and a humidity of 50%.

Since the OHP image is sensitive to deterioration in the picture quality, the "fixing performance" is decided based on the picture quality of the OHP image. In Table 1, "◎" indicates that deterioration in the picture quality by the fixing is none and deterioration in the OHP picture quality is none, "o" indicates that deterioration in the picture quality by the fixing is none but deterioration in the OHP picture quality slightly occurred, and "X" indicates that deterioration in the picture quality by the fixing occurred and deterioration in the OHP picture quality occurred.

The "releasing performance" is decided by using an ordinary paper. The used paper is a normal 55 g/m$^2$ paper, and a rate of jam occurrence is set to 98%. In Table 1, "◎" indicates that the self-releasing (self-stripping) occurred, "o" indicates that the self-stripping occurred in most of the papers but the release occurred only under the wretched conditions (high humidity, thin paper) when a top end of the paper hits a releasing guide, and "X" indicates that a winding or a jamming occurred.

Figure 2:
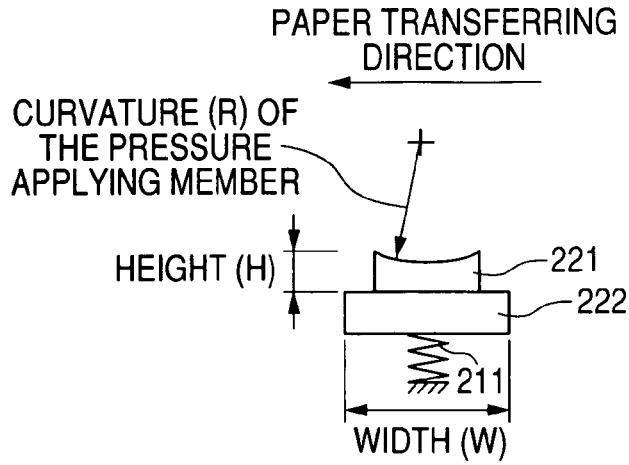
FIG. 2 is an explanatory view explaining fixing/releasing test conditions applied to an experimental device configuration in FIG. 1.
Figure 3:
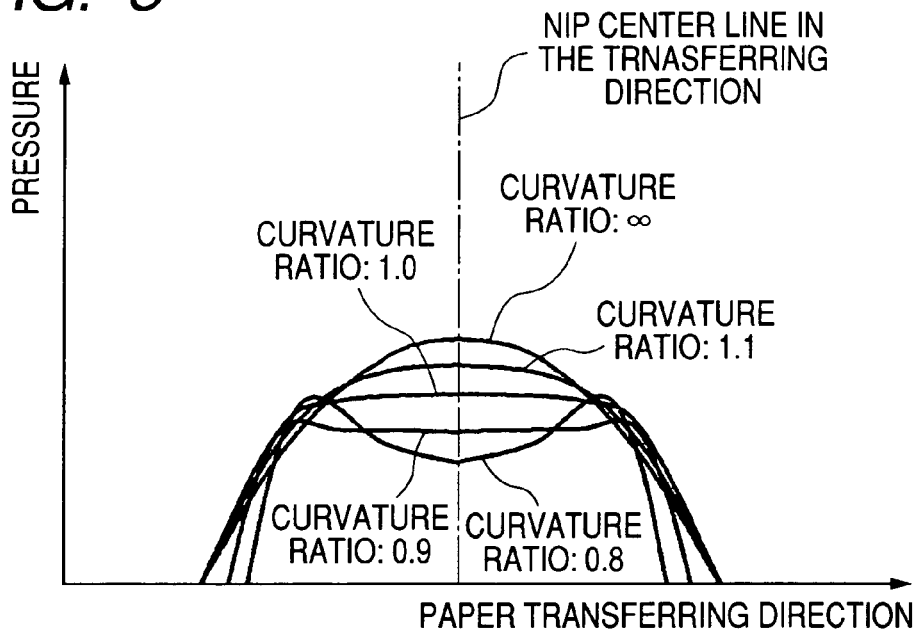
FIG. 3 is a graph showing pressure distributions applied by using the configuration in FIG. 2.

Examples of pressure distributions in the configuration shown in FIG. 2 along the transferring direction are shown every curvature ratio in FIG. 3. In this case, a dot-dash line in a graph in FIG. 3 is a centerline of the pressure applying member 221 in a nip area in the transferring direction.

TABLE 1

| (A) | (B) | (c) | (D) | (E) |
|---|---|---|---|---|
| 12.5 | 10.00 | 0.8 | X | ◎ |
| 12.5 | 11.25 | 0.9 | X | ◎ |
| 12.5 | 12.50 | 1.0 | X | ○ |
| 12.5 | 13.75 | 1.1 | ◎ | ○ |
| 12.5 | ∞ | ∞ | ○ | ○ |

(A): Radius of curvature of the surface of the heating/fixing roller (Rh) (mm)
(B): Radius of curvature of the pressure applying member (R) (mm)
(C): Curvature
(D): Fixing Property
(E): Releasing Prperty In the test, the heating/fixing roller 201 (outer diameter: 25 mm, thickness of the elastic layer: 0.8 mm, thickness of the surface coating layer: 0.03 mm, fixing temperature: 170° C.), the non-image surface side endless member 223 (outer diameter: 30 mm), and the pressure applying member 221 (width W: 12 mm, height H: 4 mm, length in the axial direction: 220 mm, rubber hardness: 30 Hs (JIS-A), total load: 40 kgf) are set as conditions. Also, the toner of 15 g/m$^2$ is put on an ordinary thin paper, and the paper is fed at a paper carrying speed of 200 mm/s.

Here, because the outer diameter of the heating/fixing roller 201 is 25 mm, a radius of curvature is 12.5 mm. Also, a recess portion is provided to a surface of the pressure applying member 221 facing to the heating/fixing roller 201, and the present test is carried out while changing gradually its radius of curvature as given in Table 1. Also, the curvature ratio set forth in Table 1 is defined by (the radius of curvature R of the pressure applying member)/(the radius of surface curvature Rh of the heating/fixing roller).

Since the local deformation is caused at the nip exit portion of the elastic layer 203 of the heating/fixing roller 201 by reducing the curvature ratio, an effect of improving the releasing characteristic could be attained. However, when the curvature ratio is set small, the pressure is lowered around the nip center portion in the transferring direction and thus the fixing characteristic is degraded (for example, the pressure distribution at the curvature ratio of 0.8 in FIG. 3). Also, when the curvature ratio is set small, it is difficult to ensure the nip width necessary for a predetermined load value.

In contrast, when the curvature ratio is set large, it is found that the fixing characteristic can be attained according to an increase in the ratio. Here, it is confirmed that the releasing characteristic is degraded gradually when the curvature ratio is increased, but the satisfactory releasing characteristic could be obtained when the curvature ratio is ∞ (flat shape in the transferring direction of the pressure applying member) This is because an amount of deformation of the nip exit portion of the elastic layer of the heating roller is reduced and a posture of the paper at the exit portion comes close to the heating roller side and thus the paper is ready to wind.

More particularly, as appreciated from Table 1, the enough fixing characteristic could not be obtained when the curvature ratio is less than 1.0, but the best result is obtained when the curvature ratio is 1.1. In this case, the better result in performance is obtained when the curvature ratio is infinity.

The releasing characteristic is best when the curvature ratio is less than 0.9, and the better result is obtained to some extent when the curvature ratio is more than 1.0.

As a result, both the fixing characteristic and the releasing characteristic can be ensured when a ratio of the radius of curvature of the pressure applying member in the transferring direction to the radius of curvature of the surface of the heating/fixing roller is set to 1.1 or more.

Therefore, if the curvature ratio is set to more than 1.1 and a protrusion shape of the pressure distribution in the transferring direction is formed on the nip portion under the above conditions (diameter of the heating/fixing roller, load, rubber hardness, rubber thickness, etc.), both the fixing characteristic and the releasing characteristic can be ensured simultaneously.

Even though the conditions are changed (for example, the diameter of the heating/fixing roller is increased, and the like), the pressure distribution on the nip portion in the transferring direction can be shaped into a protrusion shape by setting the curvature ratio to 1.1 or more. Thus, the similar effect to the present embodiment can be achieved.

In the related art, when the exit portion is elastically deformed locally by using the hard member with a small curvature, a speed difference is generated in the nip portion and as a consequence a shear in image occurs. In the related art, this problem is solved by setting the load on the exit portion, nevertheless it is basically difficult to reduce the load applied to the paper (paper damage) caused by the local deformation. This is because a curvature of the nip shape is reduced by using the hard member and also the paper load is increased because of a small curvature. In contrast, since the first embodiment of the invention can improve the releasing performance not to form such deformed portion of the nip having a small curvature, the damage to the paper can be suppressed to the lowest minimum.

Embodiment 2

Figure 4:
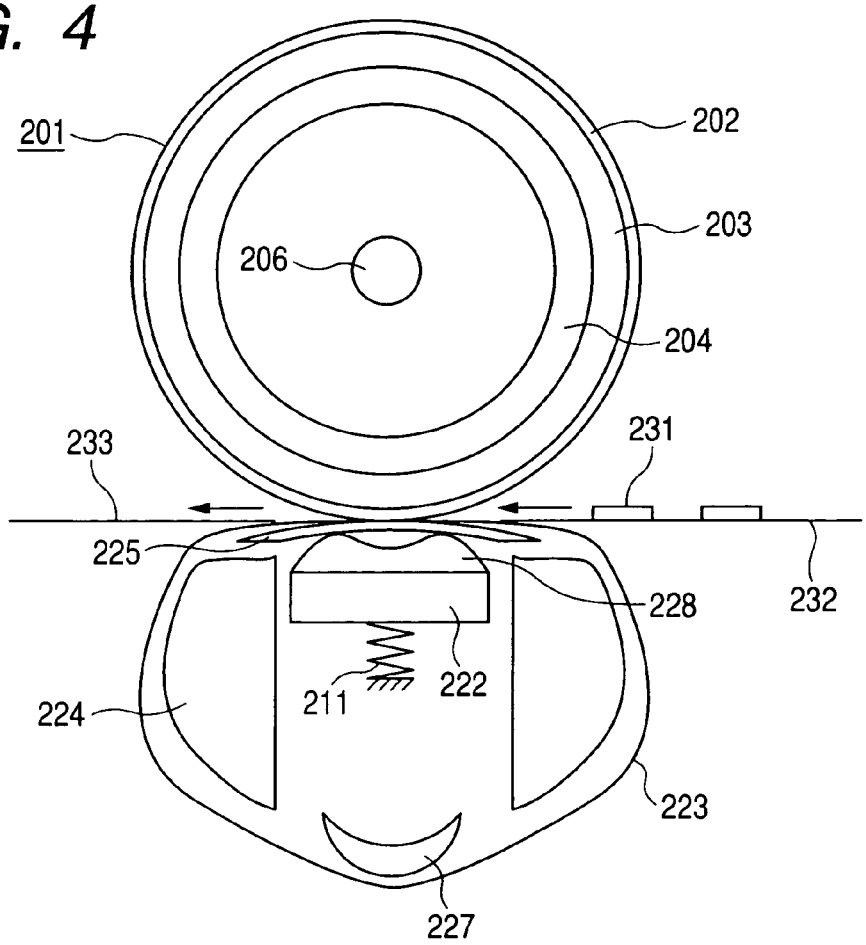
FIG. 4 is an explanatory view explaining a device configuration using a pressure applying member having an elastic member and a pressure applying member whose both end portions are formed into a curved shape to restrict a deformation of the pressure applying member.

A configuration in which the pressure applying member 221 set forth in the embodiment 1 is varied will be explained with reference to FIG. 4 hereunder.

Since the configuration except the pressure applying member 221 is similar to that in the embodiment 1, their explanation will be omitted herein.

A non-image surface side curved end unfolded-fan-type pressure applying member 228 is employed in place of the pressure applying member 221 in the embodiment 1. In the non-image surface side curved end unfolded-fan-type pressure applying member 228, a curvature is provided in the transferring direction and also both end portions in the transferring direction are shaped into a shape of an unfolded fan to prevent the deformation in the turning direction when the heating roller is rotated.

A sectional shape of the pressure applying member 228 has the shape of the unfolded fan a width of which in the transferring direction is increased gradually from the side opposing to the heating roller toward a surface on the opposite side to the surface opposing to the heating roller.

The pressure applying member 228 has at least two protrusion portions on the surface opposing to the heating roller. The top end of the protrusion portion is provided on the inner side than both end surfaces in the transferring direction respectively, and the top end of the protrusion portion has a curved shape.

In the unfolded-fan-type pressure applying member 228, because the deformation of the pressure applying member in the transferring direction is restricted, the pressure is increased at the entrance and the exit of the nip area. Accordingly, the deformation of the elastic member on the heating roller side is increased and thus the releasing performance is improved.

In its sectional shape, the curved recess shape in the center portion is connected smoothly to the unfolded fan shape at both end portions. Accordingly, the running of the non-image surface side endless member (endless belt) 223 is made smooth further, and a disturbance of the image in the fixing operation is prevented.

Like the embodiment 1, the lubricating oil supplying member 227 is provided to the back side of the endless belt to supply the lubricating oil stably. In the case of the present configuration, like the embodiment 1, the fixing device the releasing characteristic and the fixing characteristic of which are satisfactory can be obtained by setting the curvature ratio to 1.1 or more.

Figure 5:
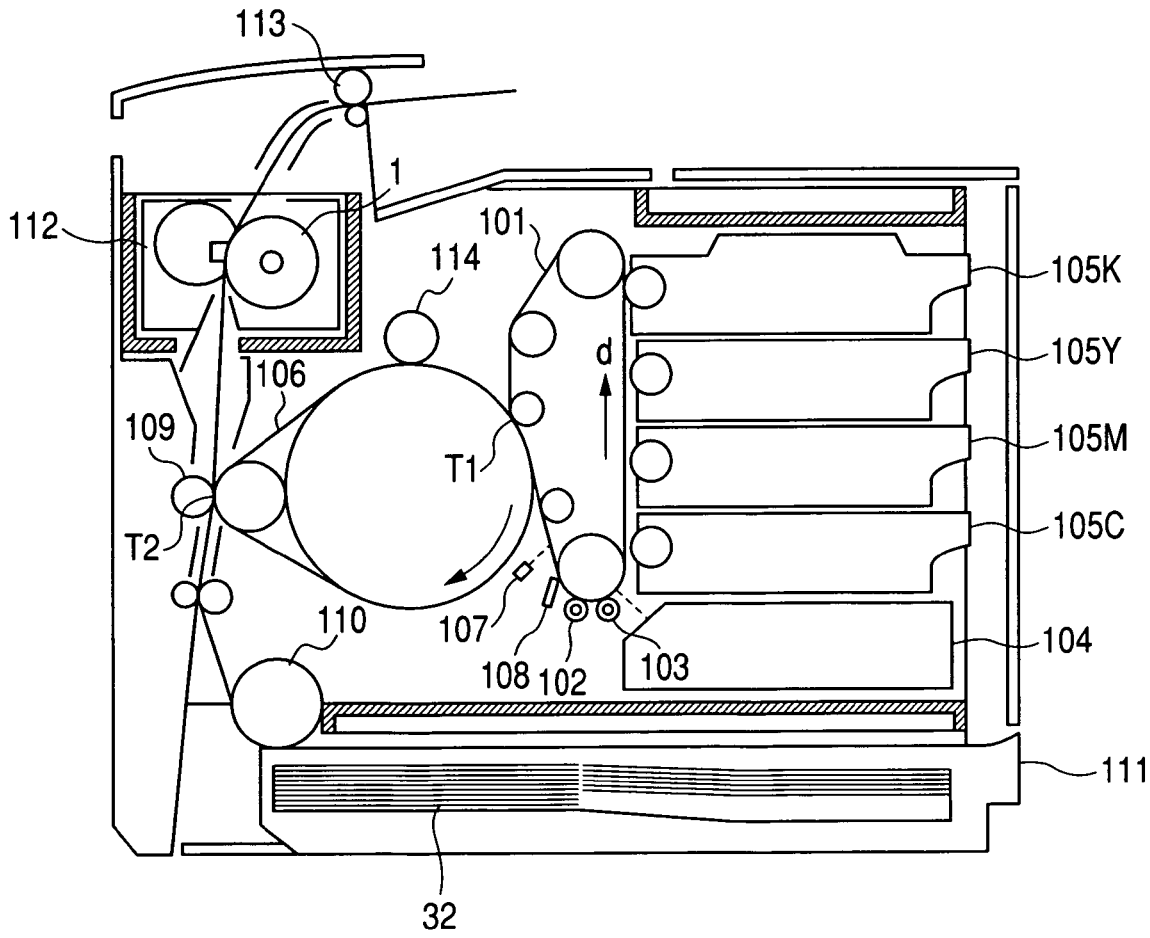
FIG. 5 is a schematic view showing an overall image forming apparatus.

Next, an example of the image forming apparatus into which the fixing device explained in the above embodiments is installed is shown in FIG. 5. In FIG. 5, 101 is a photosensitive belt that is supported endless-movably in an arrow d direction. Also, 102 is a charging brush and 103 is a charging roller. The charging brush 102 and the charging roller 103 are provided to contact a surface of the photosensitive belt 101 and charge uniformly the surface of the photosensitive belt 101. An exposure unit 104 irradiates a light onto the surface of the photosensitive belt 101 that is charged uniformly. This exposure unit 104 exposes the photosensitive belt 101 in unit of dot in accordance with image and character information provided by the personal computer, the image scanner, or the like, and forms an electrostatic latent image on the surface of the photosensitive belt 101.

A toner is supplied to the electrostatic latent image formed on the photosensitive belt 101 from any of a black toner developer 105K, a yellow toner developer 105Y, a magenta toner developer 105M, and a cyan toner developer 105C. Thus, such electrostatic latent image is rendered visible as a toner image, and then transferred to a first transfer position T1. Then, the toner image formed on the photosensitive belt 101 is transferred to a surface of an intermediate transfer member 106 in the first transfer position T1 based on a potential difference between the photosensitive belt 101 and the intermediate transfer member 106.

Then, a potential of the surface of the photosensitive belt 101, which is passed through the first transfer position T1, is decreased under a predetermined level by irradiating a light from a residual image remover 107, and thus the electrostatic latent image is erased from the surface. Then, a residual toner that is not transferred in the first transfer position T1 and still remains on the photosensitive belt 101 is removed by a cleaning device 108, and thus the surface of the photosensitive belt is brought into a next image formable condition.

The above steps are repeated by the developers 105K, 105Y, 105M, and 105C in required number. Thus, the toner image corresponding to the image and character information is formed on the surface of the intermediate transfer member 106.

Then, the toner image transferred onto the intermediate transfer member 106 is transferred onto a recording medium 32, which is supplied from a cassette 111 by a recording medium supplying device 110, by a transferring device 109 in a second transfer position T2. The recording medium 32 onto which the toner image is transferred is released from the intermediate transfer member 106 and then fed into a fixing device 1, 112. Then, the toner image is fixed onto the recording medium 32, and then the recording medium 32 is discharged by a recording medium discharging device 113. In this case, 114 is a cleaning device that cleans the surface of the intermediate transfer member 106.

When the fixing device of the embodiments is applied to such image forming apparatus, high reliability can be achieved since releasing performance of the fixing device can be improved. Also, smaller size, lower cost, and energy saving of the fixing device can be attained, smaller size, lower cost, and energy saving of the image forming apparatus can be attained. In addition, since the releasing performance can be improved, a higher speed of the image forming apparatus can be achieved and also a large load is never applied to the paper. Therefore, disturbance of the image in the fixing can be reduced to yield the higher picture quality.

Embodiment 3

Figure 7:
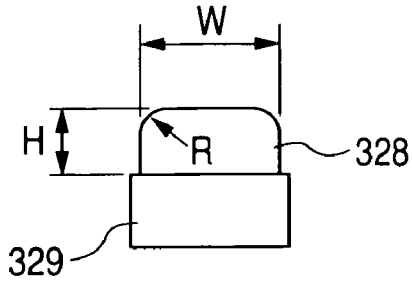
FIG. 7 is an enlarged view of a pressure applying member of the fixing device shown in FIG. 6.
Figure 8:
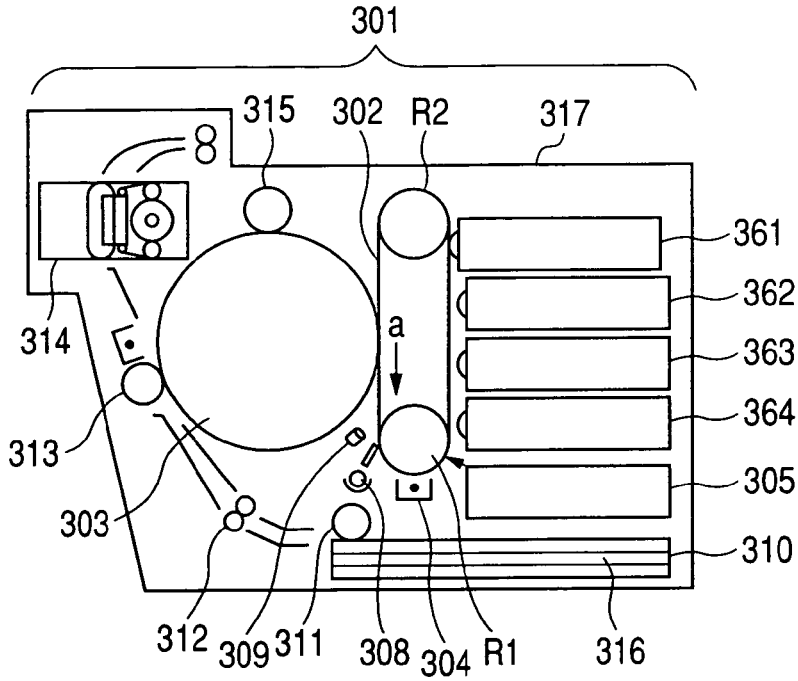
FIG. 8 is an schematic configurative view showing a color laser printer into which the fixing device shown in FIG. 6 is installed.

An image forming apparatus according to a third embodiment of the present invention will be explained based on a color laser printer shown in FIG. 6 to FIG. 8 hereinafter.

A color laser printer 301 is roughly constructed by an endless photosensitive belt 302 as a photosensitive body, an intermediate transfer member 303 arranged in a position at which this member contacts the photosensitive belt 302, and a belt nip system fixing device 314.

The photosensitive belt 302 is wound on a driving roller R2 and an idler roller R1, which also acts as a tension roller to apply a tensile force, to extend vertically and is driven at a predetermined speed in an arrow a direction. Also, an outer peripheral surface of the photosensitive belt 302 is charged uniformly by a charger 304 that is arranged in close vicinity of this belt. The charged photosensitive belt 302 is exposed by an exposure unit 305, and an electrostatic latent image is formed on a surface of the belt. Four developers 361 to 364 for developing the electrostatic latent image to form a toner image are arranged near the charged photosensitive belt 302. A cassette 310 for storing a recording medium 316 such as a paper, or the like therein, a paper feeding roller 311 for feeding the recording medium 316 from the cassette 310, and a registration roller 312 for correcting a posture of the fed recording medium 316 are provided under the exposure unit 305. A transfer roller 313 is provided in a position in which the corrected recording medium 316 comes close to the intermediate transfer member 303. This transfer roller 313 cooperates with the intermediate transfer member 303 to transfer the toner image onto the recording medium 316. In addition, the fixing device 314 for heating/fixing the recording medium 316 onto which the toner image is transferred is provided, and a paper discharge portion 317 for receiving the recording medium 316 on which the toner image is formed is provided ahead of the fixing device 314. Further, a blade 308 for removing the toner remaining on the surface of the photosensitive belt 302 after the toner image is transferred onto the intermediate transfer member 303, and an erase lamp 309 for erasing the charges remaining on the surface of the photosensitive belt 302 after the transfer are provided on the idler roller R1 side in the color laser printer 301. Also, a cleaner 315 for cleaning the toner remaining on the surface of the intermediate transfer member 303 is provided.

The fixing device 314 includes a heating/fixing roller 319 acting as an endless heating/fixing for heating/fixing an unfixed toner image 318 formed on the recording medium 316, and an endless pressure applying belt 320 for pressing the heating/fixing roller 319 via the recording medium 316.

The heating/fixing roller 319 consists of a hollow core 321 positioned in the center portion, an elastic layer 322 made of a silicon rubber, a fluorine-containing rubber, or the like provided on a surface of the core and having a heat resistance, a surface covering layer 323 made of a heat-resistant resin such as a fluororesin, or the like provided on a surface of the elastic layer, and a heat source 324 such as a halogen lamp, or the like arranged in a hollow portion of the hollow core 321.

The pressure applying belt 320 is wound on a low-friction member 325 provided along the moving direction of the recording medium 316 on the heating/fixing roller 319 side, and guide members 326A, 326B arranged in positions opposing to both sides of the low-friction member 325 in the moving direction. A pressing unit 327 for pressing the pressure applying belt 320 toward the heating/fixing roller 319 side via the low-friction member 325, and a lubricating oil supply device 331 for supplying the lubricating oil such as a silicon oil, a fluorine oil, or the like to reduce a friction between the pressure applying belt 320 and the low-friction member 325 are arranged on the inside of the endless pressure applying belt 320. Then, the pressing unit 327 has a pressure applying member 328, a supporting member 329 for supporting the pressure applying member 328, and a pressing spring 330 for pressing the supporting member 329 against the heating/fixing roller 319 side. Here, a curved surface R is formed on portions of the pressure applying member 328, which are positioned on the front and the rear of the recording medium 316 in the moving direction, respectively on the side facing to the pressure applying belt 320. Further, the pressure applying member 328 has a width that is equal to or less than a width of the nip portion, which is formed by the contact portions of the heating/fixing roller 319 and the pressure applying belt 320, in the direction orthogonal to the carrying direction of the recording medium 316. Although not shown, the pressure applying member 328 consists of a core member made of an elastic layer and a covering layer for covering a surface of the core member. Here, this covering layer is not an essential parts, and may be omitted if the core member is made of the material or is formed as a configuration that is not impregnated with a lubricating oil from the lubricating oil supply device 331.

Next, a method of recording the color image by the color laser printer 301 in the third embodiment will be explained hereunder.

First, a print signal is input into the color laser printer 301 from an information processing system (not shown) in the print standby condition after a power supply of the color laser printer 301 is turned ON. Then, the exposure unit 305 irradiates a laser beam onto the photosensitive belt 302, which is charged uniformly by the charger 304, based on the input print signal to correspond to the toner image. Thus, the electrostatic latent image is formed on the photosensitive belt 302.

More particularly, first the electrostatic latent image corresponding to the yellow-color toner image is formed on the photosensitive belt 302 by the exposure unit 305. Then, the yellow color toner image is developed by the yellow developer 361. Then, the yellow-color toner image developed on the photosensitive belt 302 is transferred onto the surface of the intermediate transfer member 303.

After the yellow-color toner image is transferred onto the surface of the intermediate transfer member 303, the yellow-color toner not transferred and still remaining onto the photosensitive belt 302 is removed by the blade 308, and also the charges still remaining on the photosensitive belt 302 are erased by the erase lamp 309.

After these steps are finished, the formation of the electrostatic latent image corresponding to the toner images in magenta color, cyan color, and black color, the development of the toner images in respective colors by the magenta developer 362, the cyan developer 363, and the black developer 364, and the transfer of the toner images in respective colors onto the surface of the intermediate transfer member 303 are executed respectively according to the similar steps. Thus, the toner images in respective colors are superposed on the intermediate transfer member 303. Here, the developing function is attached to or removed from respective developers by controlling the bias voltage.

In order to transfer the toner images in respective colors superposed on the intermediate transfer member 303 in this manner onto the recording medium 316, the paper feeding roller 311 is turned to carry the recording medium 316 stored in the cassette 310 to the registration roller 312 one sheet by one sheet, then an inclination of the recording medium 316 is corrected, and then the recording medium stands by there.

Then, the registration roller 312 is turned at a timing in registration with the toner image on the intermediate transfer member 303. Then, the transfer roller 313 is pushed against the recording medium 316 from the back at the same time when a top end of the recording medium 316 in the standby comes in touch with the intermediate transfer member 303. Thus, the toner images in respective colors superposed on the intermediate transfer member 303 are electrostatically transferred on the recording medium 316 at a time.

The unfixed toner image 318 electrostatically transferred on the recording medium 316 in this manner is moved between the heated heating/fixing roller 319 and the pressure applying belt 320 of the fixing device 314. Thus, a toner image 318P is fixed on the recording medium 316, and then the recording medium 316 is discharged into the paper discharge portion 317.

According to the color laser printer 301 explained as above, since the curved surface R is formed on the portions of the pressure applying member 328, which are positioned on the front and the rear of the recording medium 316 in the moving direction, respectively on the side facing to the pressure applying belt 320, the nip portion with a small curvature is never formed even when the elastic layer 322 of the heating/fixing roller 319 is elastically deformed by the pressure applying member 328 via the pressure applying belt 320. As a result, since an increase of the turning load of the heating/fixing roller is suppressed, a reduction of the driving torque of the heating/fixing roller 319 can be eliminated and the stable transfer of the recording medium 316 can be achieved. Also, since the nip portion with a small curvature is not formed, it can be prevented that the damage of the elastic layer 322 of the heating/fixing roller 319 is caused in a short time and thus enhancement of lifetime of the fixing device 14 containing the heating/fixing roller 319 can be attained.

Table 2 shows the experimentally checked result of relationships between the curved surface (radius of curvature) R of the pressure applying member 328 and respective characteristics. In the test of the fixing device 314, respective parameters were evaluated while changing the curved surface (radius of curvature) R of the pressure applying member 328 under the conditions that an outer diameter of the heating/fixing roller 319 is 26.6 mm, a thickness of the elastic layer 322 is 0.8 mm, a thickness of the surface covering layer 323 is 0.03 mm, a fixing temperature is 170 degrees, a radius of curvature of the pressure applying belt 320 on the side opposing to the heating/fixing roller 319 is 30 mm, a width of the pressure applying member 328 along the moving direction of the recording medium 316 is 6 mm, a height H of recording medium 316 is 4 mm, a length of the pressure applying member 328 along the axial direction of the heating/fixing roller 319 is 220 mm, a hardness of the elastic layer as the core member of the pressure applying member 328 is 30 Hs (JIS-A), and a total load is 30 kgf. In this case, an ordinary paper was used as the recording medium 316, the toner of 15 g/m2 was put thereon, and the paper was passed through the fixing device 314 at a carrying speed (moving speed) of 100 mm/s.

TABLE 2

| (A) | (B) | (C) | (D) | (E) |
|---|---|---|---|---|
| 4 | 0.0 | X | ◎ | ◎ |
| 4 | 0.2 | X | ○ | ○ |
| 4 | 0.5 | Δ | Δ | Δ |
| 4 | 1.0 | ○ | Δ | Δ |
| 4 | 1.5 | ◎ | Δ | Δ |

(A): Height of the pressure applying member (H) [mm]
(B): Radius of curvature of end portion (R) [mm]
(C): lifetime
(D): fixing Property
(E): Releasing Property
◎: excellent,
○: good,
Δ: fair,
X: not usable As a result, it was found that, when a curved surface (radius of curvature) R of the end portion of the pressure applying member 328 is set large, an overall lifetime of the fixing device 314 can be improved and also the recording medium 316 can be transferred stably. More particularly, when the curved surface (radius of curvature) R was below 0.5 mm, the fixing characteristic of the toner onto the paper and the releasing characteristic of the paper from the heating/fixing roller 319 became remarkable, but the lifetime was reduced as the overall fixing device 314 and the fixing device was unable to stand the use. Conversely, when the curved surface (radius of curvature) R was 0.5 mm or more, the fixing characteristic of the toner and the releasing characteristic of the paper were not remarkable, but the fixing device was able to stand the ordinary use. It was confirmed that, when the curved surface (radius of curvature) R is increased larger, the lifetime as the overall fixing device 314 can be enhanced.

Figure 9:
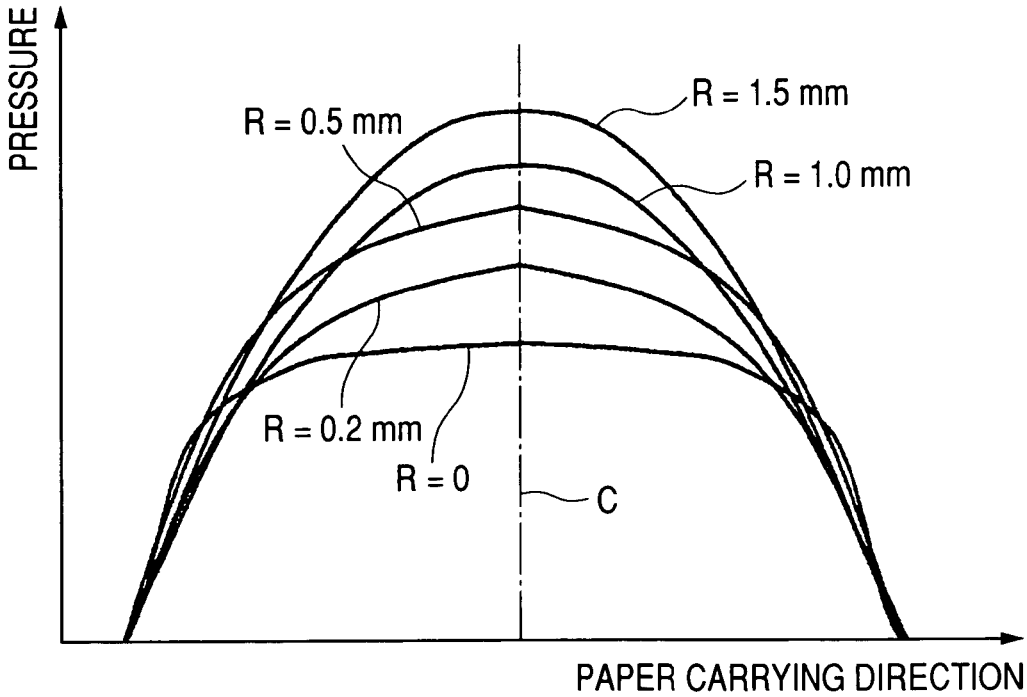
FIG. 9 is a diagram showing an end portion curve and a pressing force distribution of the pressure applying member in the fixing device shown in FIG. 6.

FIG. 9 shows a distribution of a pressing force applied by the pressure applying member 328 when the curved surface (radius of curvature) R shown in Table 2 was changed to 0, 0.2 mm, 0.5 mm, 1.0 mm, and 1.5 mm. In FIG. 9, C indicates a center portion of the nip portion, which was formed by the heating/fixing roller 319 and the pressure applying belt 320, in the moving direction of the recording medium 316. The elastic layer of the pressure applying member 328 is deteriorated by the elasticity change caused due to repeated vibration, eccentricity, environmental change, and the like. Especially, the end portion of the pressure applying member 328 is easily deteriorated because a stress is concentrated thereto. When such end portion has a shape to have an influence on the movement of the pressure applying belt 320, such deterioration causes an increase of the driving torque of the pressure applying belt 320. Therefore, it was confirmed by these experiments that, when the stress concentrated to the end portion of the pressure applying member 328 can be reduced by setting the curved surface (radius of curvature) R of the pressure applying member 328 large, especially, by setting it to 0.5 mm or more to make the movement of the pressure applying belt 320 smooth, reduction of the driving torque of the fixing device 314 and enhancement of the lifetime can be attained effectively while maintaining the fixing characteristic and the releasing characteristic.

The pressure applying member 328 having such elastic layer can be formed by various forming methods. For example, such member can be scraped out or molded. In the case of the molding, the step of manufacturing the mold and injecting the elastic material such as a silicon rubber, a fluorine-containing rubber, or the like into the mold to solidify is applied. In this step, it become often difficult to get the end portion in a predetermined curvature depending upon a curvature of the mold when hardness of the material such as a rubber is small. However, according to the third embodiment, since the radius of curvature R of the end portion is set to 0.5 mm or more, the end portion can be obtained in a predetermined curvature. Therefore, when the pressure applying member 328 is formed by the molding, yield of the material can be improved rather than the scraping and thus a production cost can be reduced.

Figure 10:
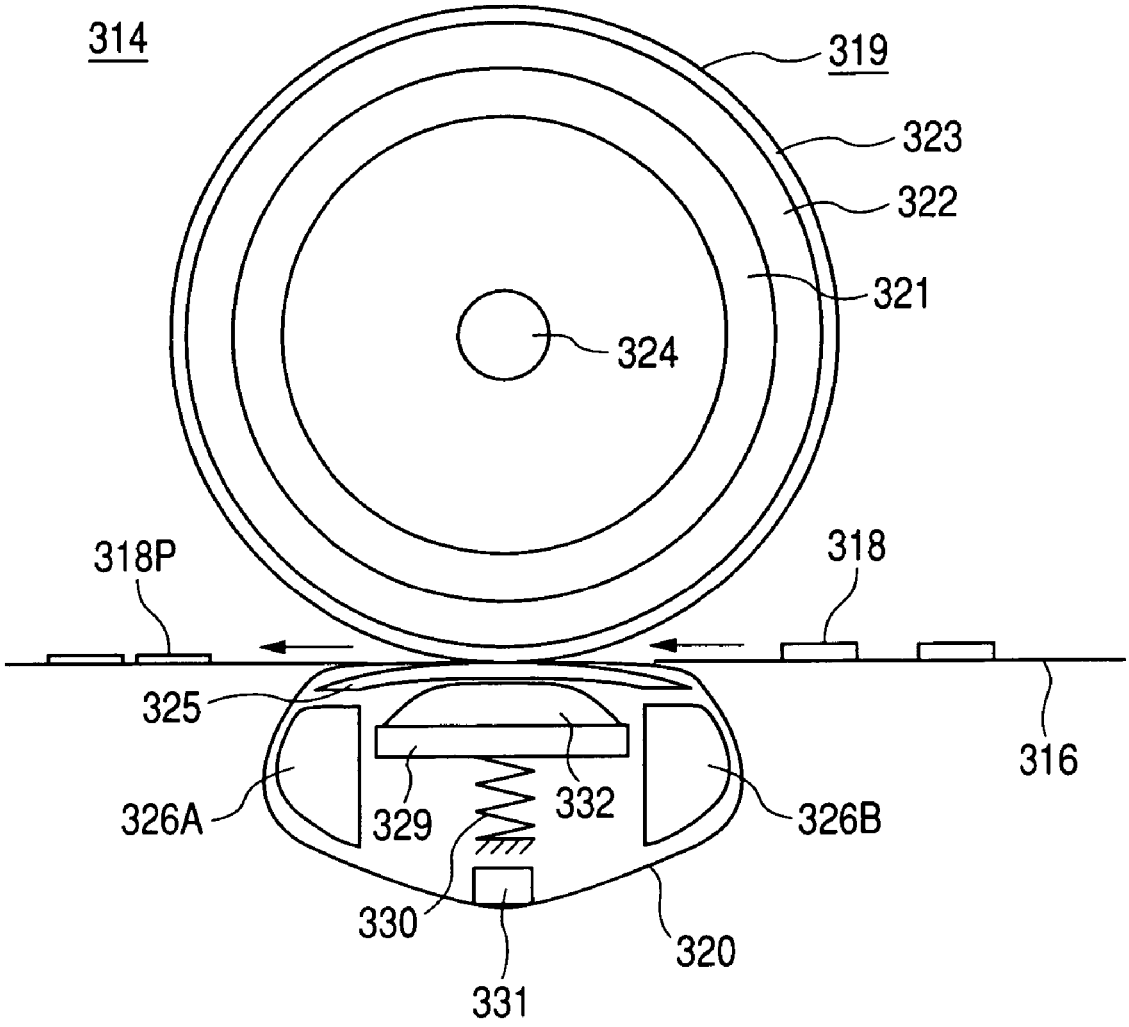
FIG. 10 is a schematic configurative view showing a first variation of the fixing device shown in FIG. 6.

FIG. 10 shows a first variation of the fixing device 314 of the color laser printer in the third embodiment. Since the same symbols as those in FIG. 6 denote the same parts, their redundant explanation will be omitted herein.

Figure 6:
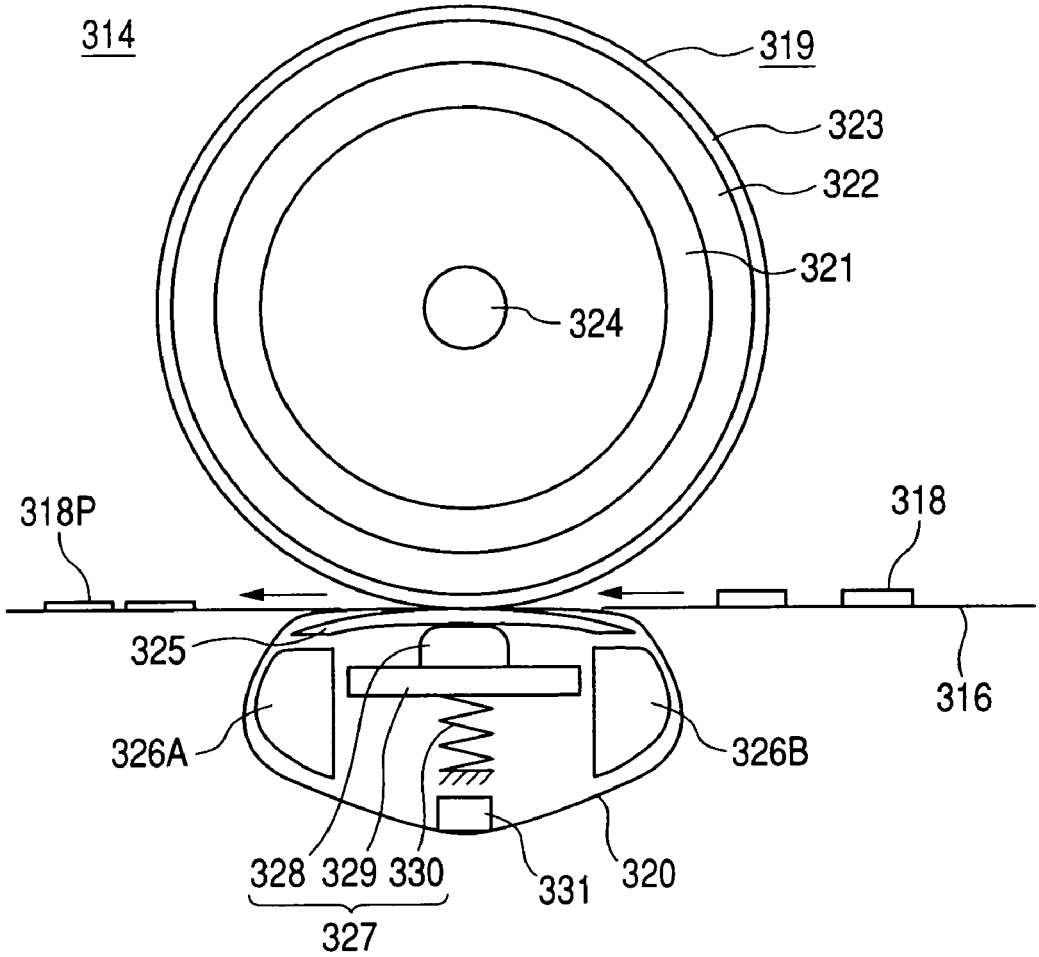
FIG. 6 is a schematic view of a fixing device in an image forming apparatus according to a third embodiment of the present invention.

In this first variation, a difference in configuration from that shown in FIG. 6 resides in that a shape of a portion of a pressure applying member 332 acting as both end portions in the carrying direction of the recording medium 316 is formed to have a gentle curvature. In this manner, since the shapes of the pressure applying member 332 at both end portions are formed to have a symmetrical gentle curvature, the deformation of the pressure applying member 332 can be suppressed and thus a formation of the nip portion between the heating/fixing roller 319 and the pressure applying belt 320 can be stabilized. Also, a sensitivity of the nip portion in a pressure distribution fluctuation can be lowered with respect to a displacement between the pressure applying member 332 and the heating/fixing roller 319.

Figure 11:
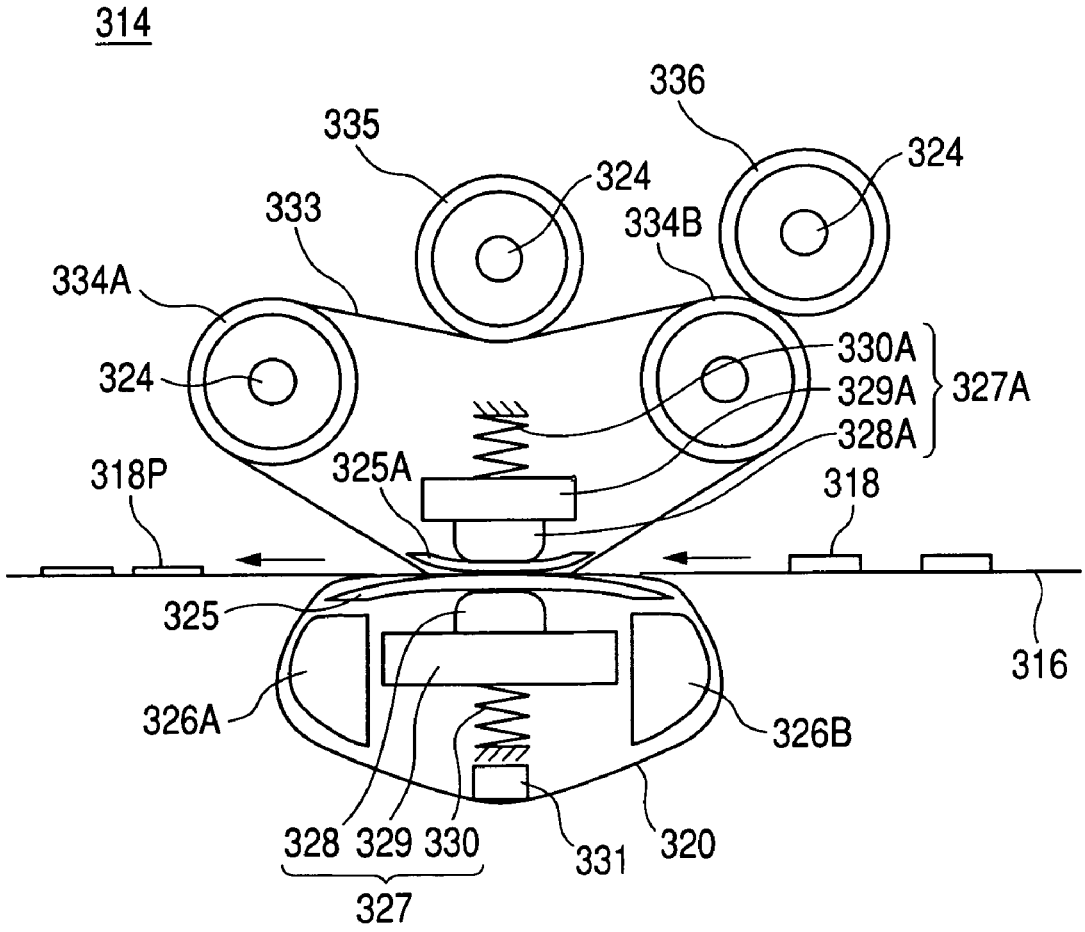
FIG. 11 is a schematic configurative view showing a second variation of the fixing device shown in FIG. 6.

FIG. 11 shows a second variation of the fixing device 314 of the color laser printer in the third embodiment. Since the same symbols as those in FIG. 6 denote the same parts, their redundant explanation will be omitted herein.

In this second variation, a difference in configuration from that shown in FIG. 6 resides in that a heating belt 333 and a pressing unit 327A are employed as the endless heating/fixing in place of the heating/fixing roller 319 in FIG. 6.

The heating belt 333 is wound on two heating rollers 334A, 334B on the inside of which the heat source 324 such as a halogen lamp, or the like is arranged respectively. A low-friction member 325A provided along the moving direction of the recording medium 316 to face the recording medium 316 side, and the pressing unit 327A for pressing the heating belt 333 via the low-friction member 325A toward the recording medium 316 side are arranged on the inner side of this heating belt 333. Like the pressing unit 327 shown in FIG. 6, the pressing unit 327A has a pressure applying member 328A on portions, which are positioned on the front and the rear of the recording medium 316 in the moving direction, of which the curved surface R is formed respectively on the side facing to the heating belt 333, a supporting member 329A for supporting the pressure applying member 328A, and a pressing spring 330A for pressing the supporting member 329A toward the heating belt 333 side. Here, the pressure applying member 328A acts as the first pressure applying member that pushes the heating belt in the present invention in one direction, while the pressure applying member 328 acts as the second pressure applying member that pushes the pressure applying belt in the present invention in the direction opposite to the pressing direction of the first pressure applying member. The curved surface having a radius of 0.5 mm or more is formed on portions, positioned the front and the rear of the recording medium 316 in the moving direction, of these first and second pressure applying members 328, 328A respectively.

According to the above configuration, since an amount of necessary heat is given to the heating belt 333 when the heating belt 333 is passed on the heating rollers 334A, 334B, the unfixed toner image on the recording medium 316 is fixed by the pressure applying member 328A. Here, when an amount of necessary heat cannot be given to the heating belt 333, a plurality of heating rollers 335, 336 can be arranged additionally to ensure the amount of heat.

According to the second variation, since the heating belt 333 is provided, a size of the fixing device 314 is not affected. Also, a bad influence on the recording medium 316 can be suppressed by adjusting shapes of the width and the exit portion of the nip portion.

What is claimed is:

1. A fixing device for fixing a toner onto a recording medium on which an unfixed toner image is formed, said fixing device comprising:

a heating roller;

an endless belt to rotate around a pressure applying member, the pressure applying member having a recess portion on a surface thereof opposed to the heating roller when the pressure applying member is not pressed toward the heating roller, the pressure applying member comprising an elastic layer that presses the endless belt against the heating roller;

a nip through which the recording medium is passed; and a low-friction member disposed between the endless belt and the pressure applying member, and provided along a moving direction of the recording medium, wherein a ratio of a radius of curvature of the recess portion in a transferring direction to a radius of curvature of an outer diameter of the heating roller is set to 1.1 or more, wherein a radius of curvature of the pressure applying member is larger than a radius of curvature of the heating roller, and wherein a pressure distribution on the nip in the transferring direction has a protrusion shape with a peak at a nip centerline.

2. The fixing device according to claim 1, wherein when viewed from a sectional section, a width of the pressure applying member with respect to the transferring direction is increased gradually from a side opposing the heating roller toward a surface on an opposite side to a surface opposing the heating roller.

3. A fixing device according to claim 1, wherein the pressure applying member includes at least two protrusion portions on a surface thereof opposing the heating roller, wherein top ends of the at least two protrusion portions are provided between both end surfaces of the pressure applying member in the transferring direction, and wherein the top ends of the at least two protrusion portions have a curved shape.

4. A fixing device according to claim 3, wherein the at least two protrusion portions are smoothly connected to the recess portion.

5. The fixing device according to claim 1, further comprising:

a lubricating oil supply device that supplies a lubricating oil on an inner surface of the endless belt.

6. An image forming apparatus, comprising:

a fixing device for fixing a toner onto a recording medium on which an unfixed toner image is formed, comprising:

a heating roller;

an endless belt to rotate around a pressure applying member, the pressure applying member having a recess portion on a surface thereof opposed to the heating roller when the pressure applying member is not pressed toward the heating roller, the pressure applying member comprising an elastic layer that presses the endless belt against the heating roller; and a nip through which the recording medium is passed; and a low-friction member disposed between the endless belt and the pressure applying member, and provided along a moving direction of the recording medium, wherein a ratio of a radius of curvature of the recess portion in a transferring direction to a radius of curvature of an outer diameter of the heating roller is set to 1.1 or more, wherein a radius of curvature of the pressure applying member is larger than a radius of curvature of the heating roller, and wherein a pressure distribution on the nip in the transferring direction has a protrusion shape with a peak at a nip centerline.

7. An image forming apparatus according to claim 6, wherein the pressure applying member has at least two protrusion portions on a surface thereof opposing the heating roller, wherein top ends of the at least two protrusion portions are provided between both end surfaces of the pressure applying member in the transferring direction, and wherein the top ends of the at least two protrusion portions have a curved shape.

* * * * *